US006230920B1

(12) United States Patent
Porter

(10) Patent No.: US 6,230,920 B1
(45) Date of Patent: May 15, 2001

(54) TRASH RECEPTACLE LID SECURING DEVICE

(76) Inventor: David R. Porter, 5007 23rd St. E., Bradenton, FL (US) 34206

( * ) Notice: Subject to any disclaimer, the term of this patent is extended or adjusted under 35 U.S.C. 154(b) by 0 days.

(21) Appl. No.: 09/391,129

(22) Filed: Sep. 7, 1999

(51) Int. Cl.[7] ..... B65D 45/32
(52) U.S. Cl. ..... 220/319; 225/315; 225/908
(58) Field of Search ..... 220/315, 319, 220/320, 908

(56) References Cited

U.S. PATENT DOCUMENTS

| | | | | |
|---|---|---|---|---|
| D. 333,715 | | 3/1993 | Mahler . | |
| 2,974,990 | * | 3/1961 | Mereness | 220/318 X |
| 2,998,276 | * | 8/1961 | Shettler | 220/315 X |
| 3,980,202 | | 9/1976 | Monyak et al. . | |
| 4,009,897 | | 3/1977 | Spellman . | |
| 4,413,851 | | 11/1983 | Ritter . | |
| 4,545,501 | | 10/1985 | DeFord . | |
| 4,976,371 | | 12/1990 | Wise et al. . | |
| 5,385,258 | | 1/1995 | Sutherlin . | |
| 5,988,017 | * | 11/1999 | Franklin et al. | 220/319 X |

*Primary Examiner*—Stephen K. Cronin
(74) *Attorney, Agent, or Firm*—Frank A. Lukasik

(57) ABSTRACT

A garbage or trash receptacle lid securing device for securing a lid to a garbage or trash receptacle. The device includes an elongated receptacle band formed of flexible pliable material having a length sufficient for circumferential engagement around an upper open end of the receptacle. A releasable connection for connecting each end of the band together is also provided for adjustably tightening and securing the band when positioned circumferentially around the receptacle. A plurality of radially spaced lid straps are each connected one to another at a mid point thereof and, at each end thereof, at spaced apart points to and along said band. The lid straps are of sufficient length whereby, when said band is circumferentially engaged and tightened in position around the receptacle with the lid in a closed position atop the receptacle, the lid straps are automatically tightly positioned centrally across the lid in a generally radially evenly spaced apart relation one to another for lid retention. Alternately, the receptacle band and lid straps may either or both be formed of elastic material for self-biasing engagement, the receptacle band thus being formed as a continuous stretchable loop.

1 Claim, 4 Drawing Sheets

TRASH RECEPTACLE LID SECURING DEVICE

BACKGROUND OF THE INVENTION

1. Scope of Invention

This invention relates generally to receptacles having a receptacle lid, and more particularly to a trash or garbage receptacle lid securing device, the lid being separate from the receptacle.

2. Prior Art

A broad variety of trash and garbage receptacle assemblies, typically now formed of molded plastic, include a separate removable receptacle lid which is frictionally engageable in place over the open upper end of the receptacle to resist wind and animal intrusion. However, these lids are well known to easily become detached from atop the receptacle in the face of stronger winds and persistent animal efforts to obtain access to the contents of the trash receptacle.

A number of prior art devices are known to address this issue of retaining the lid in its in-use position until proper access is gained by, for example, trash collector employees. However, one serious defect in many of these prior art inventions is that removal of the lid by a trash collector worker may be too difficult. Should this occur, the wrath of the worker is typically directed to total destruction of the entire receptacle, the contents being strewn about in the process of this destructive frustration. These known prior art devices are shown as follows:

U.S. Pat. No. 4,976,371 to Wise et al.

U.S. Pat. No. 4,545,501 to DeFord

U.S. Pat. No. 4,413,851 to Ritter

U.S. Pat. No. 4,009,897 to Spellman

U.S. Pat. No. 3,980,202 to Monyak et al.

U.S. Pat. No. Des. 333,715 to Mahler

U.S. Pat. No. 5,385,258 to Sutherlin

U.S. Pat. No. 5,758,914 to Loveno

With regard to the Wise '371 invention, perhaps the opposite effect is a likely consequence in that the Wise structure, only having a single lid strap, is likely to be subject to premature lid removal as the retention mode of this invention would appear to be somewhat inadequate. Wise, therefore, provides little in the way of lid retention instead focusing only on keeping the lid in proximity to the receptacle.

In DeFord, a simple lid retainer is shown formed of resilient strip material which require specifically configured receptacle handles for engagement with the looped ends of this device.

In the '851 patent, Ritter discloses a flexible, non-elastic strap which appears to require engagement around a lid handle and is thus structurally limited on that basis. A similar lid retention tie-down is disclosed in the Spellman '897 reference, this device dependent upon receptacle handles and the lid handle for stabilizing the lid in its in-use position and for engagement of a third leg of the device to a post to stabilize the entire receptacle assembly.

Another simple device for lid retention is shown in the '202 reference by Monyak et al., whose primary intention is again primarily to prevent the lid from being completely separated from the receptacle should the lid become disengaged by either wind or animal intrusion. The Mahler '715 design patent discloses an entire animal-proof trash can lid having specially designed pivotal c-shaped latches for engagement with the lip of the receptacle.

Sutherlin, in the '258 reference, teaches a rigid two-part ringed structure mechanically connectable to the upper end of the trash receptacle and pivotally supporting a lid which is thus permanently retained to the trash receptacle in a pivotally openable and closeable relationship thereto.

Lovino, in the '914 patent shows yet another garbage can lid tether having jaws at each end of an elastic rope-like structure to prevent total separation of the lid from the receptacle.

The present invention provides all of the beneficial features of lid retention in the in-use position atop and enclosing a trash receptacle so as to render the trash receptacle assembly virtually totally wind and animal resistant while easily removable by a trash collection worker. Deployment of the invention is easy and simple once the lid is in its closed position so as to uniformly maintain the lid in its closed contact with the receptacle providing strong wind resistance and preventing animal intrusion. Moreover, either the elastic nature of one embodiment of the invention and/or the quick release buckle associated with the preferred embodiment of the receptacle band facilitate quick disengagement during trash collection operations.

BRIEF SUMMARY OF THE INVENTION

This invention is directed to a garbage or trash receptacle lid securing device for securing a lid to a garbage or trash receptacle. The device includes an elongated receptacle band formed of flexible pliable material having a length sufficient for circumferential engagement around an upper open end of the receptacle. A releasable connection for connecting each end of the band together is also provided for adjustably tightening and securing the band when positioned circumferentially around the receptacle. A plurality of radially spaced lid straps are each connected one to another at a mid point thereof and, at each end thereof, at spaced apart points to and along said band. The lid straps are of sufficient length whereby, when said band is circumferentially engaged and tightened in position around the receptacle with the lid in a closed position atop the receptacle, the lid straps are automatically tightly positioned centrally across the lid in a generally radially evenly spaced apart relation one to another for lid retention. Alternately, the receptacle band and lid straps may either or both be formed of elastic material for self-biasing engagement, the receptacle band thus being formed as a continuous stretchable loop.

It is therefore an object of this invention to provide an easily deployable trash receptacle lid retaining device.

It is another object of this invention to provide a trash receptacle lid retaining device which affords improved resistance to wind detachment of the lid or lid removal by animals, both domestic and wild.

It is still another object of this invention to provide a trash receptacle lid retaining device which is easily detachable by trash collection workers so as to minimize delay in lid removal and emptying of the contents of the trash receptacle during normal trash collection operations.

It is still another object of this invention to provide a trash receptacle lid retaining device which does not depend on handle structure of the receptacle or lid for alignment or support in accomplishing the intended lid retaining purposes.

In accordance with these and other objects which will become apparent hereinafter, the instant invention will now be described with reference to the accompanying drawings.

DETAILED DESCRIPTION OF THE INVENTION

Figure 1:
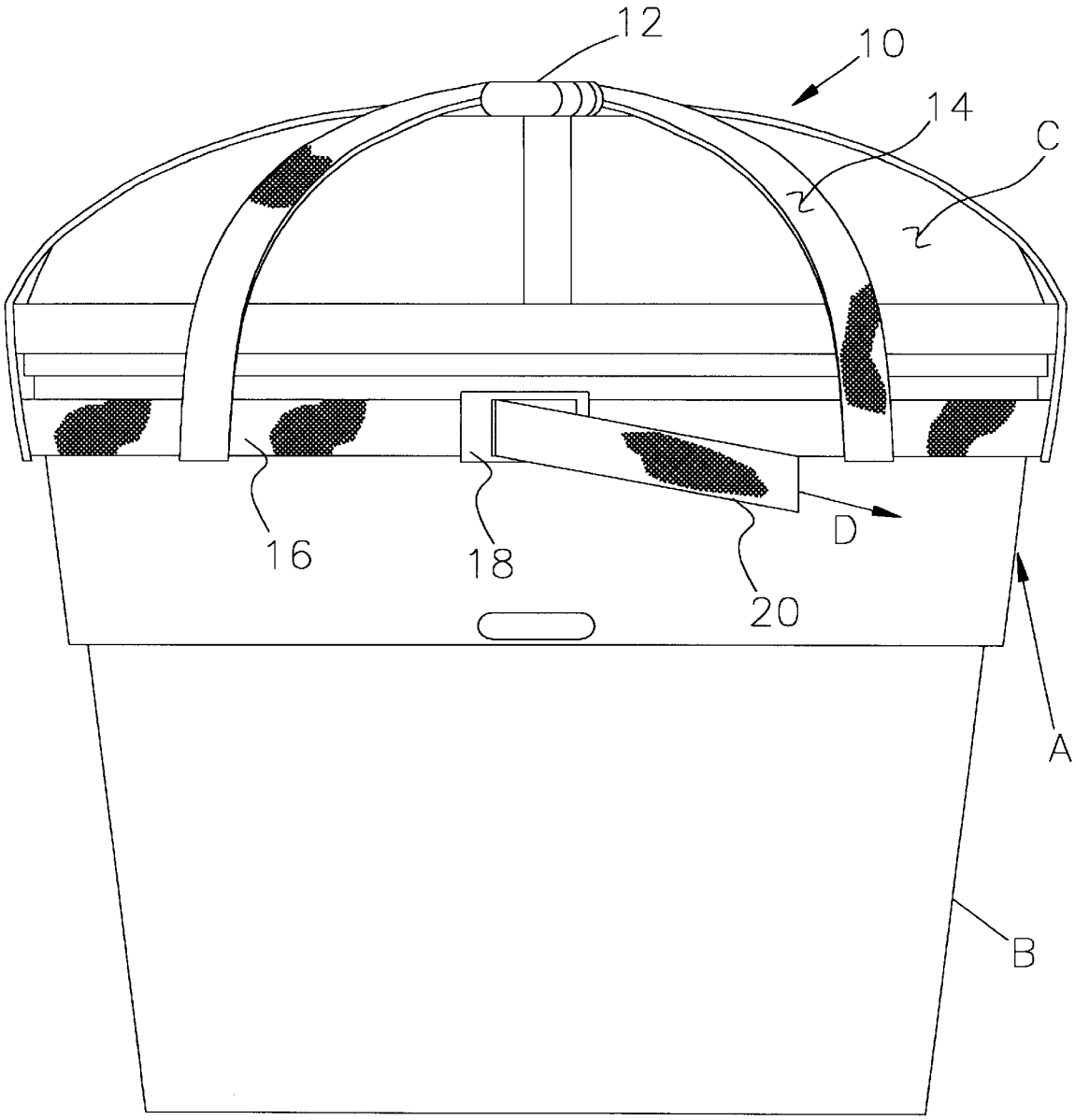
FIG. 1 is a side elevation view of the preferred embodiment of the invention.
Figure 2:
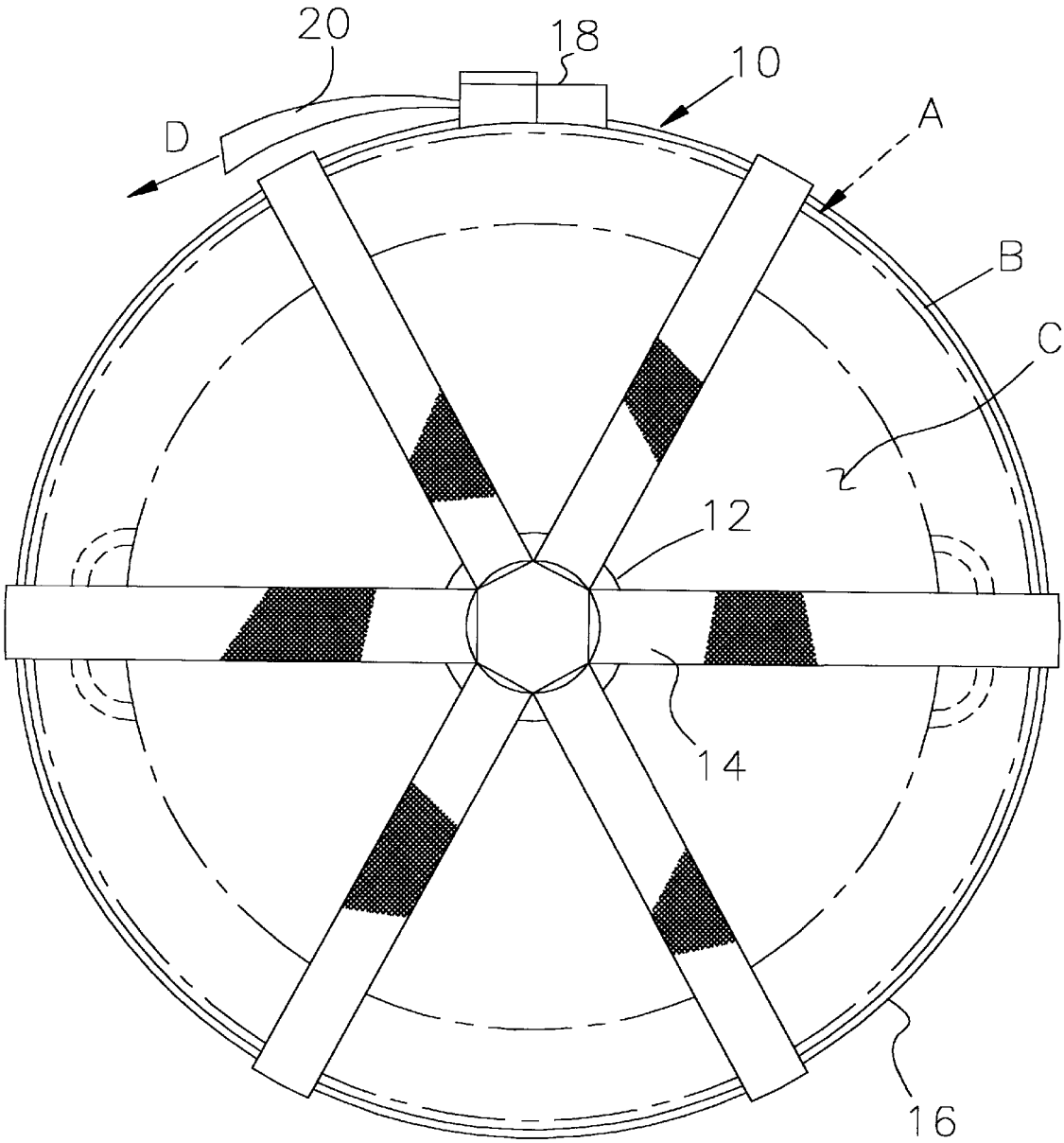
FIG. 2 is a top plan view of FIG. 1 showing the trash receptacle and lid in phantom for clarity.

Referring now to the drawings and particularly to FIGS. 1 and 2, the preferred embodiment of the invention is there shown generally at numeral 10 in relation to a conventional trash receptacle assembly A and includes an elongated receptacle band 16 formed of flexible, pliable fabric strap material and a plurality of lid retaining straps 14 formed of similar material. The receptacle band 16 has a length sufficient to circumferentially engage around the upper open end of the receptacle B. The receptacle band 16 is held in place in a loop form by a two-part adjustable buckle arrangement 18 which facilitates quick engagement and disengagement of the receptacle band 16 to and from the trash receptacle B. Moreover, quick and positive tightening is facilitated by pulling the distal end 20 of the receptacle band 16 in the direction of the arrow B.

Lid retaining straps shown typically at 14 are connected to and radially extend from a rigid ring 12 as by stitching and the like. At least three, and preferably six such lid retaining straps 14 are provided in evenly spaced radially extending relation to the central ring 12. The opposite ends of each of the lid retaining straps 14 are connected, again as by stitching, to the receptacle band 16. The length of each lid retaining strap 14 is uniform and generally of sufficient length so that, when the ring 12 is placed centrally atop the lid C in its in-use position as shown atop the lid C, the receptacle band 16 is positioned just below the upper lipped open end of the receptacle B as shown. By providing at least three evenly angularly oriented retaining straps 14 (six shown), a greater resistance to slippage and inadvertent or unwanted lid removal is provided.

Figure 3:
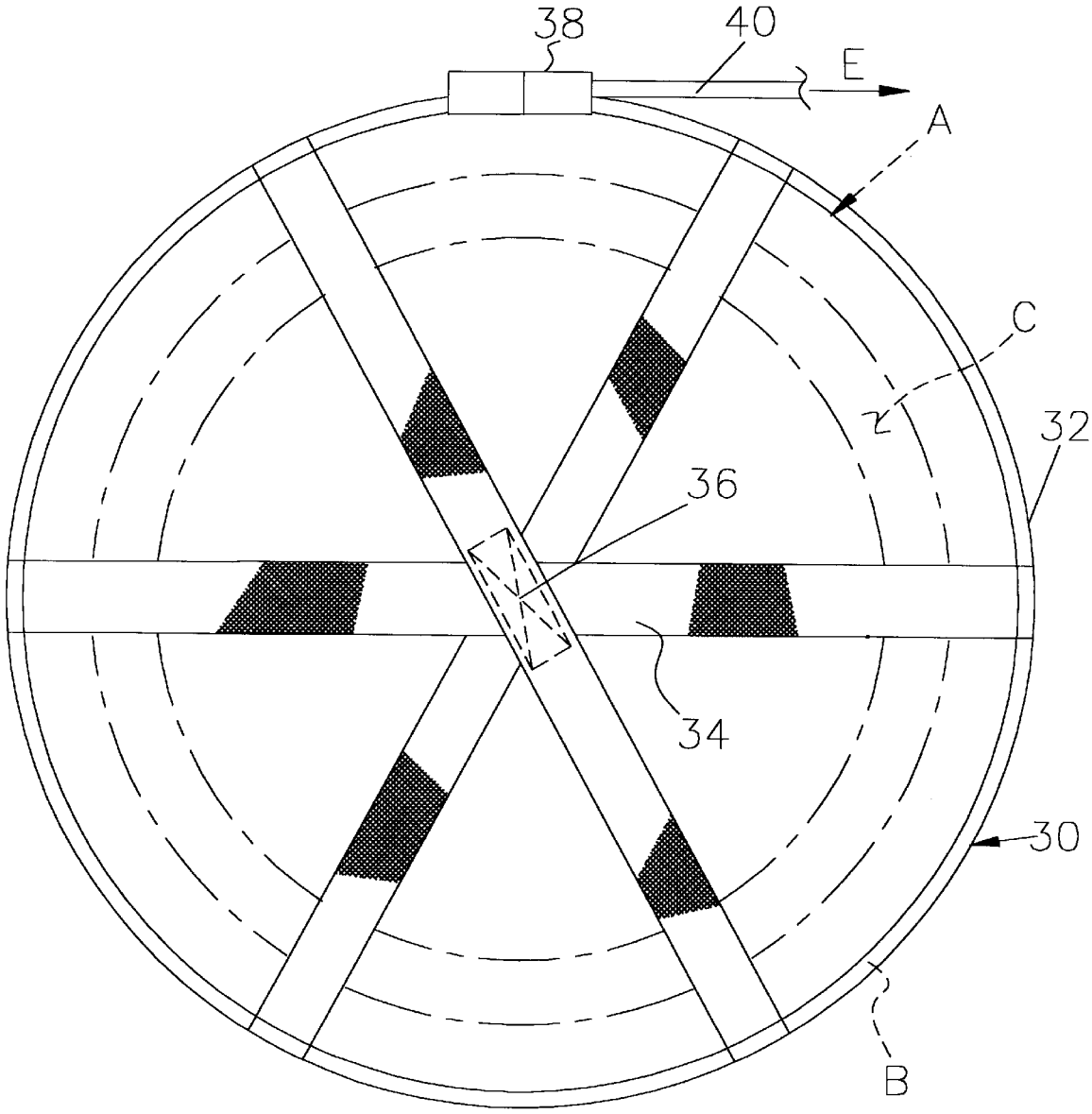
FIG. 3 is a top plan view of another embodiment of the invention in use, again showing the trash receptacle and lid in phantom for clarity.

Referring now to FIG. 3, another embodiment of the invention is there shown generally at numeral 30 in conjunction with the trash receptacle assembly A which includes the receptacle B and removable lid C. This embodiment 30 also includes a flexible, pliable receptacle band 32 constructed of material similar to that of the embodiment 10 of FIG. 1. Likewise, the lid retaining straps 34 are formed of similar pliable flexible strap material. However, in this embodiment 30, the lid retaining straps 34 are formed each of a single elongated piece of strap material connected as by sewing at each end thereof to opposite points along the length of the receptacle band 32. The lid retaining straps 34 are then connected centrally one to another in radially evenly spaced orientation by stitching at 36.

The receptacle band 32 is detachable by a two-part buckle 38 as previously described and is tensionable after being placed around the upper end of the trash receptacle B by pulling on the distal end 40 of the receptacle band 32 in the direction of arrow E after the two-part buckle 38 has been engaged.

Figure 4:
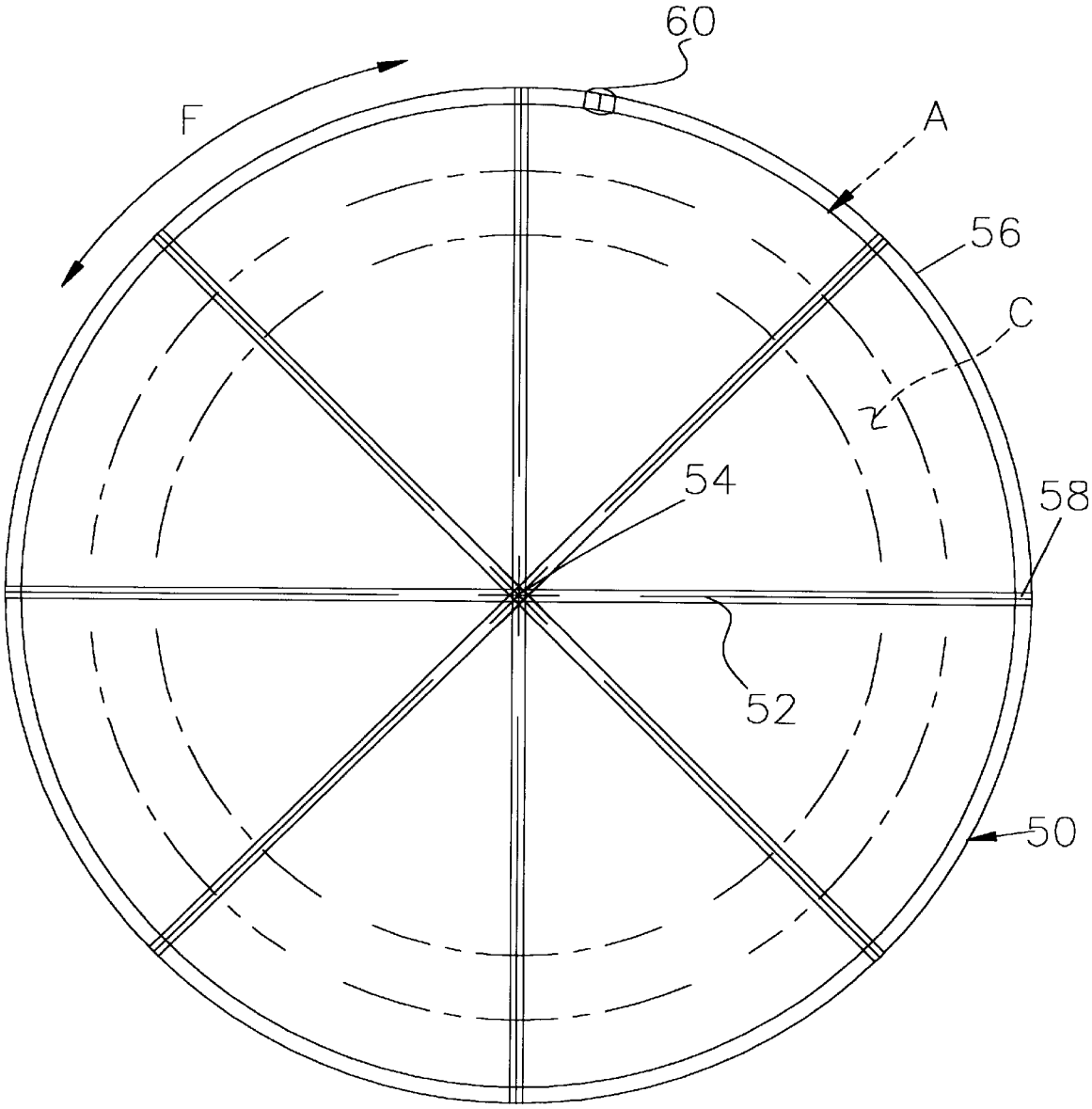
FIG. 4 is a top plan view of still another embodiment of the invention showing the trash receptacle and lid in phantom for clarity.

Yet another embodiment of the invention is shown in FIG. 4 at 50. This embodiment 50 is generally elastic in nature so that the trash receptacle band 56 is formed as a continuous loop by attachment of the mating ends thereof at 60. The free or relaxed length or circumference of the receptacle band 56 is somewhat smaller than that of the trash receptacle B so that the receptacle band 56 must be stretched circumferentially in the direction of arrow F to effect its installation circumferentially around the upper end of the receptacle B.

This embodiment 50 includes lid retaining straps 52 formed of flexible, optionally elastic cord material which are attached at each end thereof to opposite points along the receptacle band 56 and centrally one to another along the respective lengths thereof at 56, each of the lid retaining straps 52 being radially oriented evenly one to another about 54.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A garbage or trash receptacle lid securing device for securing a lid to a garbage or trash receptacle, comprising:

an elongated receptacle band formed of flexible, pliable material having a length sufficient for circumferential engagement around an upper, open end of the receptacle;

a two-part adjustable buckle arrangement for connecting each end of said band together and for thereafter adjustably tightening of said band when positioned circumferentially around the receptacle;

six radially spaced lid straps, each formed of flexible pliable materials, and connected to and radially extending from a rigid ring by stitching, and, connected at each end thereof, at spaced apart points along said band, said lid straps of sufficient length whereby, when said band is circumferentially engaged and tightened in position around the receptacle with the lid in a closed position atop the receptacle, said lid straps are automatically tightly positioned centrally across the lid for positive lid retention.

* * * * *